US006864844B2

(12) United States Patent
Sato

(10) Patent No.: US 6,864,844 B2
(45) Date of Patent: Mar. 8, 2005

(54) ANTENNA DEVICE CAPABLE OF BEING COMMONLY USED AT A PLURALITY OF FREQUENCIES AND ELECTRONIC EQUIPMENT HAVING THE SAME

(75) Inventor: Masahide Sato, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 10/205,364

(22) Filed: Jul. 26, 2002

(65) Prior Publication Data

US 2003/0020661 A1 Jan. 30, 2003

(30) Foreign Application Priority Data

Jul. 27, 2001 (JP) ..... 2001-227115

(51) Int. Cl.[7] ..... H01Q 1/36
(52) U.S. Cl. ..... 343/702; 343/744
(58) Field of Search ..... 343/702, 744, 343/741, 745, 700 MS, 742, 867, 749, 846, 866

(56) References Cited

U.S. PATENT DOCUMENTS

| | | | | |
|---|---|---|---|---|
| 2,615,134 A | | 10/1952 | Carter et al. | 250/33.67 |
| 3,268,900 A | | 8/1966 | Waszkiewicz | 343/742 |
| 4,518,965 A | | 5/1985 | Hidaka | 343/742 |
| 6,300,908 B1 | * | 10/2001 | Jecko et al. | 343/700 MS |
| 6,480,158 B2 | * | 11/2002 | Apostolos | 343/700 MS |
| 6,690,331 B2 | * | 2/2004 | Apotolos | 343/744 |

FOREIGN PATENT DOCUMENTS

| | | |
|---|---|---|
| DE | 973 146 | 12/1959 |
| EP | 0 332 139 | 7/1989 |
| JP | 62-191207 | 12/1987 |
| JP | 63-171004 | 7/1988 |
| JP | 2-57003 | 2/1990 |

* cited by examiner

*Primary Examiner*—James Vannucci
(74) *Attorney, Agent, or Firm*—McGinn & Gibb, PLLC

(57) ABSTRACT

In an antenna device 10 including a line-shaped or belt-shaped first conductor 11 having an electrically half length of a wave-length of a first resonant frequency, a feed point 12 to which an end of the first conductor is connected, a plate-shaped second conductor 13 on which the feed point is located and on which another end of the first conductor is grounded, an impedance element 14 is loaded halfway on the first conductor and which varies the first resonant frequency, a second resonant frequency, or both the first resonant frequency and the second resonant frequency. Accordingly, a compact antenna device 10 can therefore be constituted so that an impedance matching between the first conductor 11 and the feed point 12 may be readily obtained. In addition, the antenna device 10 can be commonly used with respect to a multi-frequency operation.

39 Claims, 21 Drawing Sheets

LOADED ON (A) NEAR FEED POINT (b/4) :h=0.125 λ 1.b=0.25 λ 1

LOADED ON (B) CENTER OF PARALLEL PORTION (b/2) :h=0.125 λ 1.b=0.25 λ 1

LOADED ON (C) NEAR GROUND PORTION (3b/4) :h=0.125 λ 1.b=0.25 λ 1

FIG.9A
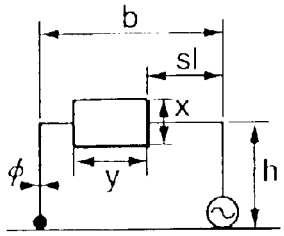
FIG.9B
| PARAMETER (mm) | TYPE | | |
|---|---|---|---|
| | A | B | C |
| x | 12.0 | 12.0 | 12.0 |
| y | 9.5 | 9.5 | 9.5 |
| b | 39.0 | 39.0 | 39.0 |
| h | 12.0 | 12.0 | 12.0 |
| sl | 22.0 | 25.5 | 28.5 |
| ϕ | 1.0 | 1.0 | 1.0 |
FIG.9C
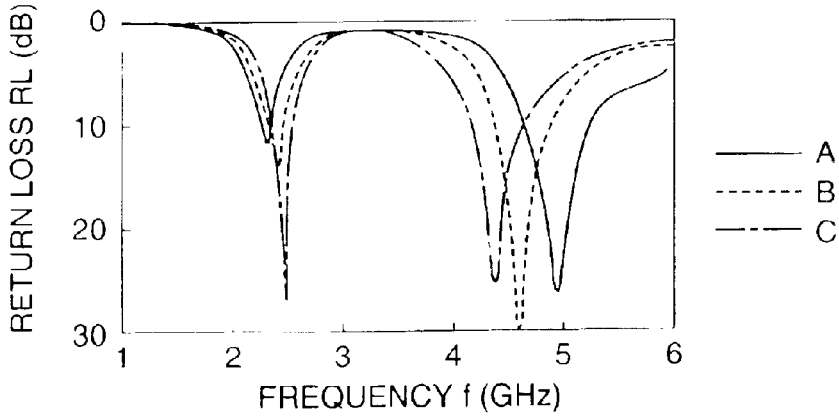
IMPEDANCE ELEMENT IS PARALLEL TO CONDUCTIVE PLATE
FIG.9D
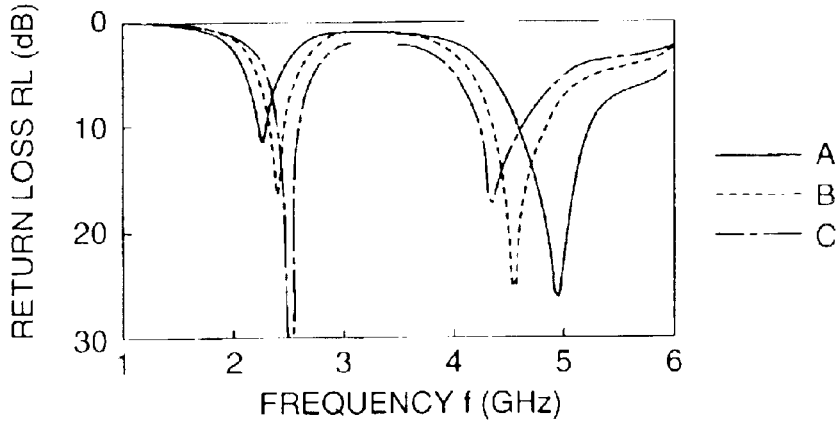
IMPEDANCE ELEMENT IS PERPENDICULAR TO CONDUCTIVE PLATE FIG.19A
FIG.19B
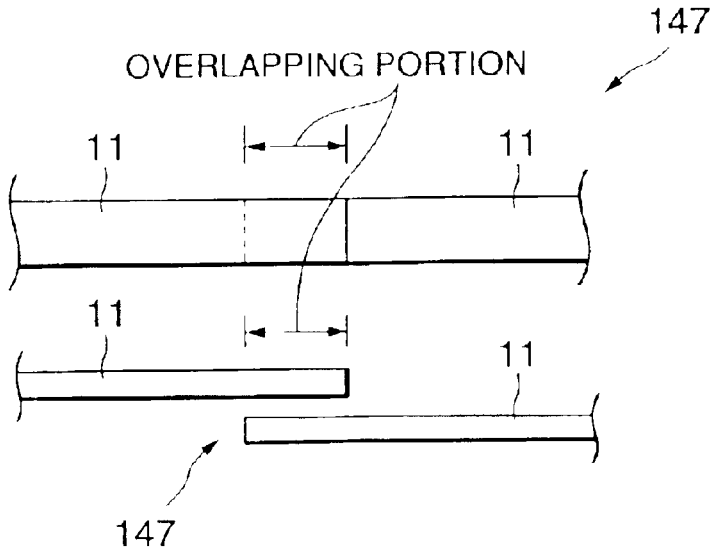
FIG.20
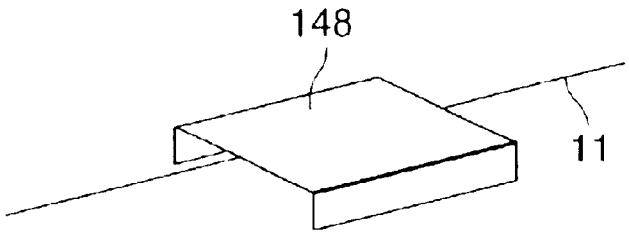

| PARAMETER (mm) | TYPE | | |
|---|---|---|---|
| | A | B | C |
| h1 | 7.0 | 7.0 | 7.0 |
| h2 | 0.0 | 3.0 | 7.0 |
| b1 | 54.0 | 51.0 | 51.0 |
| h1+h2+b1 | 61.0 | 61.0 | 65.0 |

| PARAMETER (mm) | TYPE | | |
|---|---|---|---|
| | A | B | C |
| h3 | 7.0 | 7.0 | 7.0 |
| h5 | 3.5 | 3.5 | 3.5 |
| b2 | 24.0 | 27.0 | 34.0 |
| b3 | 31.0 | 27.0 | 21.0 |
| 2*(h3+b2+b3) | 69.0 | 68.0 | 69.0 |

ANTENNA DEVICE CAPABLE OF BEING COMMONLY USED AT A PLURALITY OF FREQUENCIES AND ELECTRONIC EQUIPMENT HAVING THE SAME

BACKGROUND OF THE INVENTION

The present invention relates to an antenna device and an electronic equipment having the antenna device, in particular to an antenna device contained in an electronic equipment which can be commonly used at a plurality of frequencies capable of being utilized in a radio communication.

In addition to Local Area Network(LAN)s which are widely used in desk-top type computers, wireless LANs, for example, the Bluetooth system, that can be used also in portable type computers have been spread in a computer network in recent years. As a specification of an antenna device for a radio communication used in such a portable type computer, the following items are required.

Namely, a multi-frequency operation, for example, one frequency band of 2.4 GHz and another frequency band of 5.2 GHz. Herein, in order that the portable type computer may be responsive to both the frequency bands, it has been conventionally required that the portable type computer has two kinds of antenna devices. However, it is difficult to obtain spaces for mounting the two kinds of antenna device, respectively, since the portable type computer is designed to be as small as possible in size and weight. Accordingly, it is required that even a single antenna device can be responsive to both the frequency bands so that the spaces for mounting the antenna device may be as small as possible in a portable type computer.

Further, since the portable type computer is designed to be as small as possible in size and weight, as mentioned above, it is preferable that the antenna device can be contained in the portable type computer. Accordingly, it is, of course, required that the antenna device is small in size. In addition, it is further required that the antenna device is not easily influenced electrically from an adjacent housing body, or the like.

For example, a wire antenna, such as a dipole antenna, a monopole antenna, and the like resonates at a frequency of integer times (one, two, three . . . ) as large as a predetermined frequency, in a case that the wire antenna has an antenna-length of approximately ninety-five percentages as long as a wave-length of as half as the predetermined frequency. However, between the two frequencies usable in the wireless LAN (hereunder called first and second frequencies), second frequency is not integer times (one, two, three . . . ) as large as first frequency, as mentioned before. As a result, concerning a conventional dipole antenna, or the like, a single antenna device cannot be responsive to both the frequency bands.

Accordingly, an example of a conventional antenna device is disclosed in unexamined Japanese patent publication Hei2-57003, namely, 57003/1990. In order to be responsive to both the frequency bands mentioned above, the conventional antenna device disclosed therein has two dipole antennas resonating at first, second frequency, respectively. The two dipole antennas are located in parallel in the same feed line and supplied with electric power transversely. However, in the conventional antenna device having two dipole antennas, not only a structure of the antenna device inevitably becomes large in size but also a constitution of an impedance matching section becomes complicated. Further, the conventional antenna device having the two dipole antennas is disadvantageous in actual use, since loss is increased in the feeder thereof, and the like.

On the other hand, an input impedance of a conventional dipole antenna, and the like becomes low almost down to short-circuit impedance near a metal conductor, particularly when an interval between the conventional dipole antenna and the metal conductor is not longer than a wave-length of one-tenth of the predetermined frequency. In addition, each of the first and the second resonant frequencies comes to a frequency characteristic having a narrow band. As a result, when the dipole antenna, and the like is contained in a computer, it becomes difficult to obtain impedance matching between an antenna element and a feeding system thereof. Further, it also becomes difficult to generally use the dipole antenna, and the like by way of a coaxial cable, and the like.

Accordingly, as an antenna device capable of being commonly used at the first and the second frequencies, a proposal is made about an antenna device in which a parasitic element resonating at the second frequency is additionally located in a dipole antenna resonating at the first frequency. For example, not only in unexamined Japanese utility model publication Sho62-191207, namely, 191207/1987 but also in unexamined Japanese patent publication Sho63-171004, namely, 171004/1988, disclosure is, respectively, made about an antenna device that a parasitic element consisting of a feed-less element is additionally located near a dipole antenna resonating at the first frequency, so that a resonant characteristic of the second frequency can be obtained in the antenna device.

However, the resonant characteristic of the second frequency is obtained in the antenna device by additionally locating the parasitic element, limitation is caused to occur for a position and a size of the parasitic element in the antenna device. Further, the antenna device becomes large in size by a size of the parasitic element. In view of a radiation characteristic of the dipole antenna, it is necessary for the antenna device to be separated from the adjacent metal conductor, and the like by a distance of a quarter wave-length of the first frequency approximately, and integer times as large as the first frequency in addition thereto. As a result, a space of not smaller than the wave-length of one-fourth of the first frequency is required for mounting the antenna device in the computer.

Under the circumstances, as an antenna device capable of being contained in a computer by readily obtaining impedance matching between an antenna element and a feeding system thereof, a proposal is made about an antenna device, such as a loop antenna, a folded dipole antenna, and the like, each of which is a wire antenna that an input impedance is increased by folding an antenna element.

However, in the above-mentioned antenna device that is a wire antenna, such as a loop antenna, a folded dipole antenna, and the like, a resonant frequency of the antenna device depends on an antenna length thereof. It is therefore difficult to adjust the second frequency after the first frequency has been adjusted.

SUMMARY OF THE INVENTION

Therefore, a feature of the present invention is to provide an antenna device which is capable of being commonly used at a multi-frequency operation and being contained in an electronic equipment.

Another feature of the present invention is to provide an electronic equipment having an antenna device of the type described.

Other features of the present invention will become clear as the description proceeds.

According to an aspect of the present invention, there is provided an antenna device for use in an electronic equipment, comprising: a first conductor having an electrically half wave-length of a first resonant frequency; a feed point to which an end of said first conductor is connected; a plate-shaped second conductor on which said feed point is located and on which another end of said first conductor is grounded; and an impedance element which is loaded on said first conductor and which varies at least one of said first resonant frequency and a second resonant frequency.

The impedance element may vary said first resonant frequency.

The impedance element may vary said second resonant frequency.

The impedance element may vary both said first resonant frequency and said second resonant frequency.

The first conductor may be formed to be semi-rectangular.

The first conductor may be line-shaped.

The first conductor may be belt-shaped.

The first conductor may have a primary portion elongating from said plate-shaped second conductor and a secondary portion other than said primary portion, wherein said primary portion may be formed to have a length between 0.05 and 0.10, both inclusive, of a wave-length of a first resonant frequency.

Preferably, the length of said primary portion may be between 0.07 and 0.08, both inclusive, of said wave-length of said first resonant frequency.

The impedance element may be located on said secondary portion with being offset from a center of said secondary portion towards a side of a portion on which said first conductor is grounded.

The impedance element may be a lumped capacitance or inductance element.

The lumped capacitance or inductance element may be formed to be rectangular.

The first conductor may be formed on a dielectric block having a hexahedron shape.

The first conductor may be formed on a dielectric substrate.

The first conductor may be formed on said plate-shaped second conductor as a complement pair structure.

According to another aspect of the present invention, there is also provided an electronic equipment including said antenna device, said electronic equipment transmitting information to the outside thereof and receiving information from the outside thereof by a radio communication using said antenna device.

BRIEF DESCRIPTION OF THE DRAWINGS

FIGS. 9A through 9D are views for showing a relation between the frequency and the return loss, when a distance from the feed point to a loading position of the impedance element is varied, wherein the impedance element of a lumped capacitance or inductance element is located in parallel to a principal surface of the conductive plate in FIG. 9C while the impedance element of a lumped capacitance or inductance element is located perpendicular to the principal surface of the conductive plate in FIG. 9D;

FIGS. 19A and 19B are seventh views for schematically showing a variation of a configuration of an impedance element of a lumped capacitance or inductance element in the antenna device illustrated in FIG. 1;

FIG. 20 is an eighth view for schematically showing a variation of a configuration of an impedance element of a lumped capacitance or inductance element in the antenna device illustrated in FIG. 1;

DETAILED DESCRIPTION OF THE PREFERRED EMBODIMENTS

Figure 1:
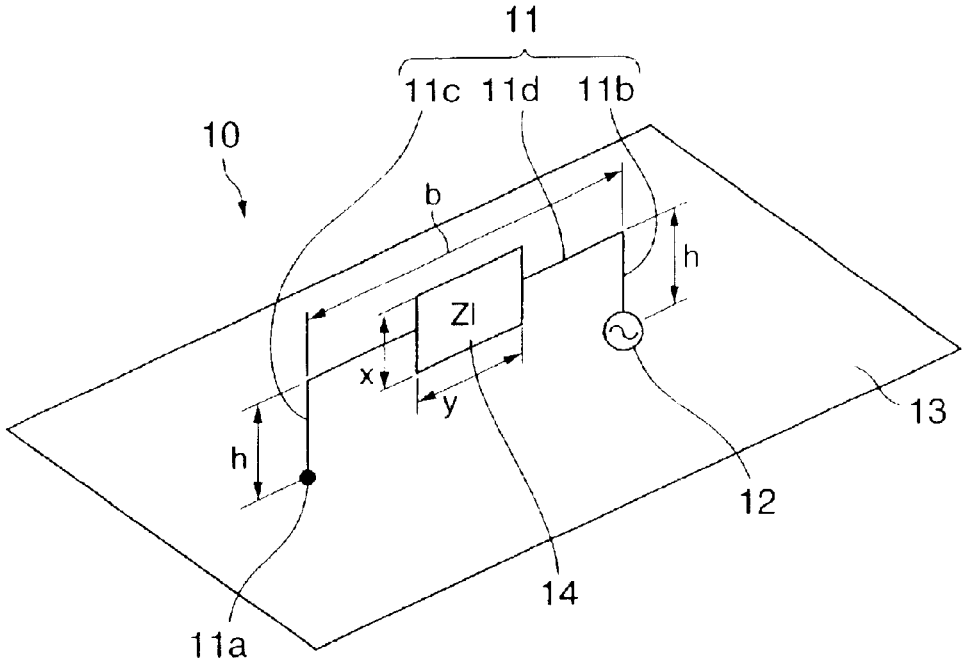
FIG. 1 is a perspective view for schematically showing an antenna device according to a first embodiment of the present invention.

Now, referring to FIGS. 1 through 9, description will proceed to antenna devices according to first and second embodiments of the present invention. FIG. 1 is a perspective view for schematically showing an antenna device according to the first embodiment of the present invention.

As illustrated in FIG. 1, the antenna device 10 comprises an antenna element (first conductor) 11, a feed point 12, a conductive plate (second conductor) 13, and an impedance element 14. The antenna element 11 is formed to have a shape of a semi-rectangular line. One end of the antenna element 11 is connected to the feed point 12 while another end of the antenna element 11 is grounded on the conductive plate 13 through a ground portion 11*a*. The feed point 12 is located on the conductive plate 13 through an insulating layer (not shown). The impedance element 14 is loaded halfway on the antenna element 11.

Figure 2:
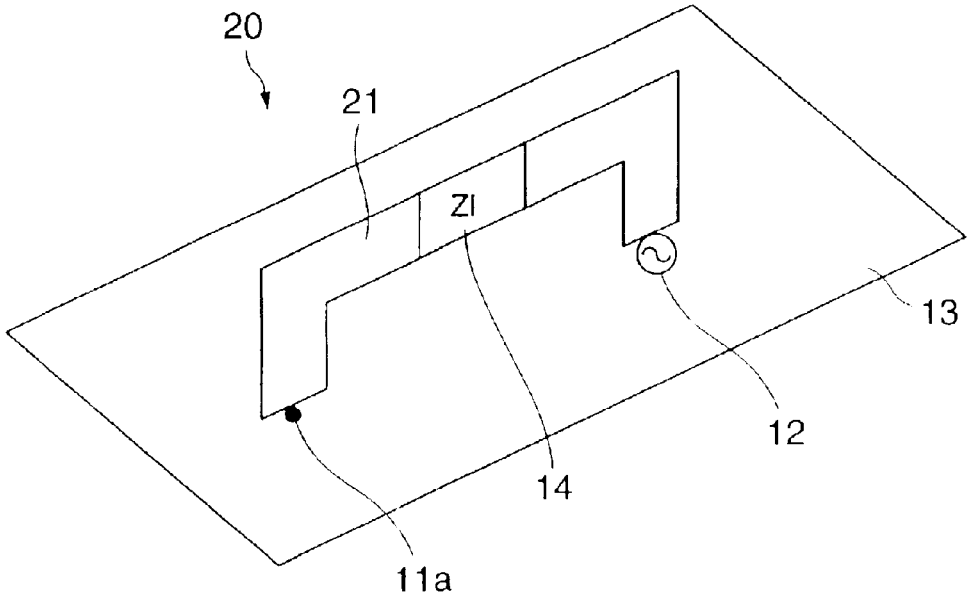
FIG. 2 is a perspective view for schematically showing an antenna device according to a second embodiment of the present invention.

FIG. 2 is a perspective view for schematically showing an antenna device according to the second embodiment of the present invention. The antenna device 20 according to the second embodiment illustrated in FIG. 2 has a structure basically similar to that of the antenna device 10 illustrated in FIG. 1 except that an antenna element (first conductor) 21 is formed to have a shape of a semi-rectangular belt in the antenna device 20. Similar portions are designated by like reference numerals and explanations thereof are omitted accordingly. With the structure, the antenna device 20 also brings meritorious operations and effects similar to those of the antenna device 10 illustrated in FIG. 1. Besides, description is hereunder made as regards operations and effects of only the antenna device 10 illustrated in FIG. 1, for convenience of explanation.

Figure 3A:
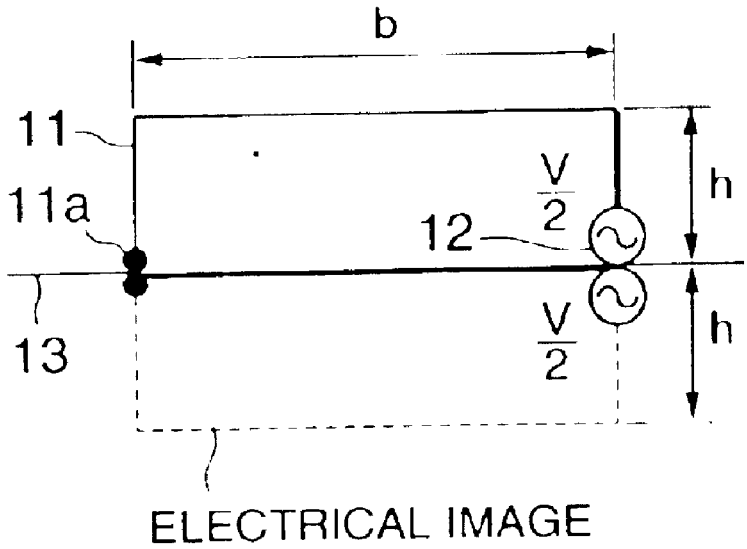
FIGS. 3A and 3B are views for explaining a principle of the antenna device illustrated in FIG. 1.
Figure 3B:
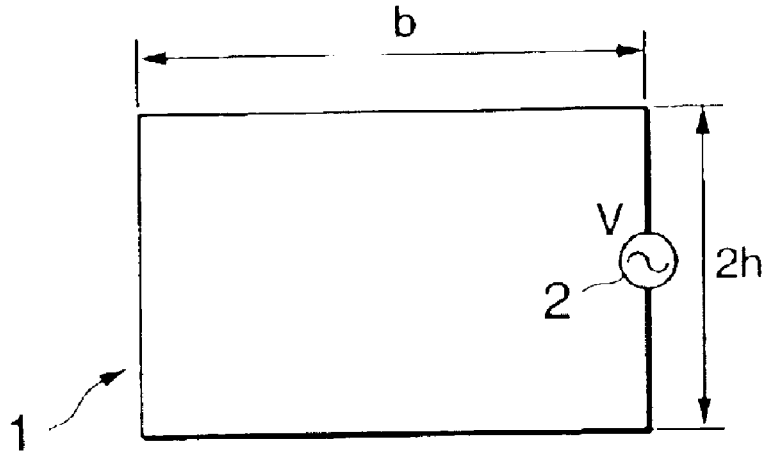

Referring to FIGS. 3A and 3B with reference to FIG. 1 continued, description proceeds to the operations and the effects of the antenna device 10. As illustrated in FIG. 1, the antenna element 11 of the antenna device 10 includes not only portions elongating perpendicularly from the conductive plate 13, namely, a feeding side perpendicular portion 11*b* and a grounding side perpendicular portion 11*c* but also a portion other than the perpendicular portions 11*b* and 11*c*, namely, a parallel portion 11*d*. The antenna element 11 is formed on a condition that an added value of length (h) of the feeding side perpendicular portion 11*b*, length (h) of the grounding side perpendicular portion 11*c*, and length (b) of the parallel portion 11*d* is electrically a half length ($0.5\ \lambda_1$) of a wave-length of the first resonant frequency (f1). The antenna element 11 having such a structure can be considered as depicted in FIGS. 3A and 3B, when the impedance element 14 is ignored.

Namely, as illustrated in FIG. 3A, the antenna element 11 located on the conductive plate 13 can be picked up its electrical image shown by a broken line at a symmetrical position with respect to the conductive plate 13. Further, as illustrated in FIG. 3B, it can be considered that a loop antenna 1 is composed of both the antenna element 11 and the electrical image thereof to have the perimeter of a wave-length ($1\lambda$) of the first resonant frequency (f1).

In other words, the antenna element 11 located on the conductive plate 13 becomes equal to a half of the loop antenna 1 formed by setting a conductive plain plate on a central plane perpendicular to a loop plane of the loop antenna 1 including the feed point 2. In this case, a voltage (V) of the feed point 2 is equivalently divided into a half voltage (V/2) on portions above and under the conductive plain plate, respectively. In addition, the portions above and under the conductive plain plate each having the half voltage (V/2) are connected in series to each other. At this time, an input impedance and a radiation resistance of the antenna element 11 located on the conductive plate 13, that is, a half of the loop antenna 1, as mentioned before, become one half of those of the original loop antenna 1. On the other hand, a radiation characteristic of the antenna element 11 becomes similar to that of the original loop antenna 1. The antenna device 10 can therefore be constituted so that not only an impedance matching between the antenna element 11 and the feed point 12 may be readily obtained but also the size of the antenna device 10 may be made compact without changing the radiation characteristic.

Figure 4:
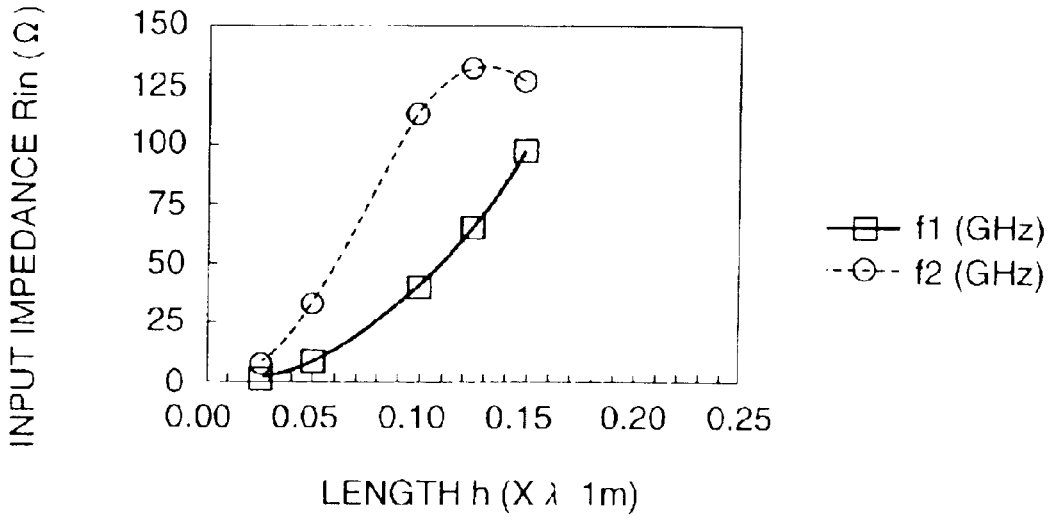
FIG. 4 is a graph for showing a relation between a length of a feeding side perpendicular portion (a grounding side perpendicular portion) and an input impedance (input resistance) in first and second frequencies, respectively, of an antenna element located on a conductive plate in the antenna device illustrated in FIG. 1.

Herein, FIG. 4 is a graph for showing a relation between a normalized by wave length (h) of the feeding side perpendicular portion 11*b* (the grounding side perpendicular portion 11*c*) and an input impedance (input resistance) (Rin[Ω]) in the first and the second frequencies (f1[GHz]), (f2[GHz]), respectively, of the antenna element 11 located on the conductive plate 13. As will be clearly understood from the graph depicted in FIG. 4, an impedance matching can be readily obtained at a characteristic impedance (Z0) of 50 [Ω], when the length (h) of the feeding side perpendicular portion 11*b* (the grounding side perpendicular portion 11*c*) is between 0.05 and 0.10, both inclusive, preferably 0.07 and 0.08, both inclusive.

The impedance element (Z1=R1+jX1) 14 is, for example, a capacitance, an inductance, or the like used in an electronic circuit or a lumped capacitance or inductance element composed of an element having certain size and configuration. In this embodiment, a pure reactance element (X1) of no loss (R1=0) is used as the impedance element 14. The reactance element (X1) may be either capacitive (X1<0) and inductive (X1>0). The resonant frequency of the antenna device 10 can be made higher by loading the reactance element (X1) capacitive (X1<0). On the contrary, the resonant frequency of the antenna device 10 can be made lower by loading the reactance element (X1) inductive (X1>0). Accordingly, the antenna device 10 can obtain resonant characteristic at a desirable frequency with the impedance element 14 being optimized.

Figure 5:
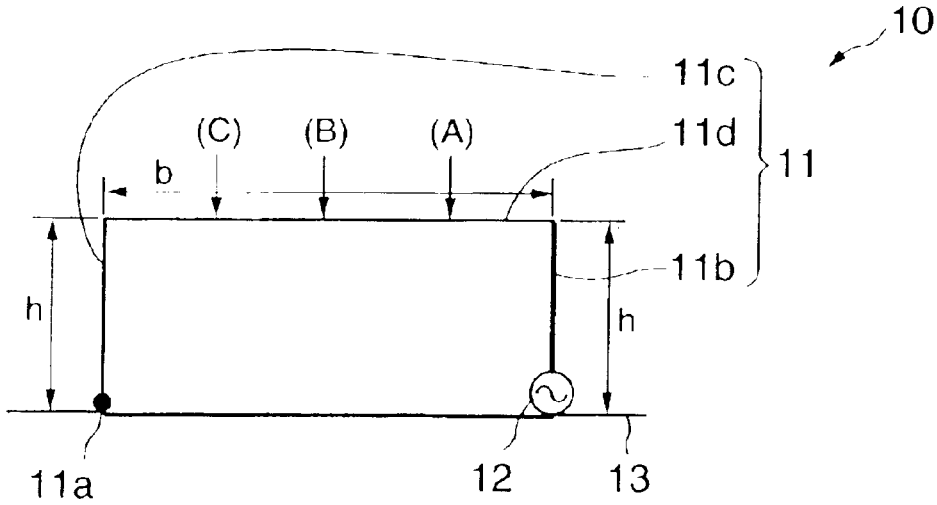
FIG. 5 is a view for schematically showing a loading position of a reactance element of a capacitance or an inductance in the antenna device illustrated in FIG. 1.

Herein, referring to FIGS. 5 and 6, description is made as regards loading position of the reactance element (X1) of the capacitance or inductance in the antenna element 11 of the antenna device 10. Further, description is also made as regards variation of an input impedance (Zin=Rin+jXin) at the first and the second frequencies (f1) and (f2), when the loading position of the reactance element (X1) of the capacitance or inductance is moved in the antenna element 11 of the antenna device 10. As illustrated in FIG. 5, each the length (h) of the feeding side perpendicular portion 11*b* and the grounding side perpendicular portion 11*c* is 0.125 $\lambda_1$ while the length (b) of the parallel portion 11*d* is 0.25 Ω1 in the antenna element 11.

Further, the loading position of the reactance element (X1) is moved as illustrated in FIG. 5. Namely, first, the reactance element (X1) is loaded at a position (A)[b/4] near the feed point 12, as illustrated in FIG. 5. Second, the reactance element (X1) is loaded at a central position (B)[b/2] of the parallel portion 11*d*. Third, the reactance element (X1) is loaded at a position (C)[3*b*/4] near the ground portion 11*a*. Subsequently, variation of the input impedance (Zin=Rin+jXin) at the positions (A), (B), and (C) illustrated in FIG. 5 are depicted in FIGS. 6A, 6B, and 6C, respectively.

Figure 6A:
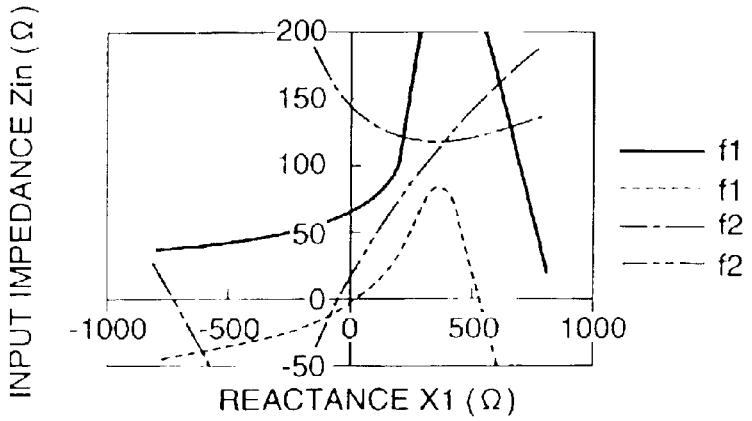
FIGS. 6A, 6B and 6C are views for schematically showing a change of an input impedance at the first and the second frequencies in the loading position illustrated in FIG. 5.

In the position (A)[b/4] near the feed point 12, variation of an input impedance (Zin) at the first frequency (f1) becomes small as shown by an actual line illustrated in FIG. 6A, when the reactance element (X1) is capacitive (X1<0). On the other hand, variation of an input impedance (Rin) at the second frequency (f2) becomes large as shown by an alternate long and short dash line illustrated in FIG. 6A.

Further, variation of an input impedance (Zin) at the first frequency (f1) becomes large as shown by a dotted line illustrated in FIG. 6A, when the reactance element (X1) is inductive (X1>0). On the other hand, variation of an input impedance (Rin) at the second frequency (f2) becomes small as shown by an alternate long and two short dash line illustrated in FIG. 6A. Accordingly, variation of an input impedance (Xin) becomes gentle as shown by an alternate long and two short dash line illustrated in FIG. 6A.

Figure 6B:
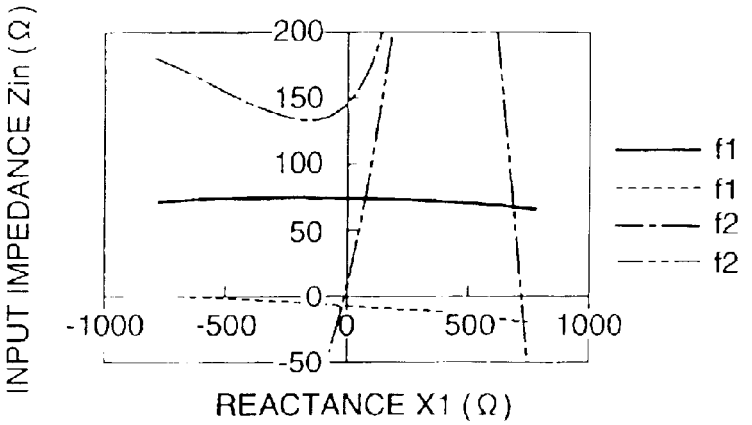
Figure 6C:
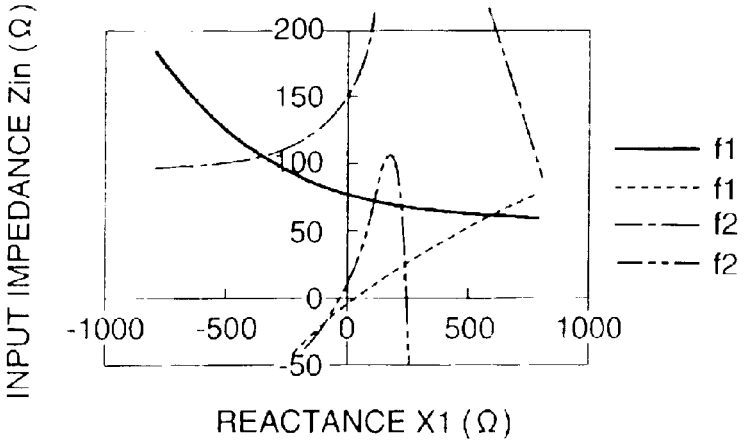

At the center of the parallel portion 11*d*, variation of an input impedance (Zin) at the first frequency (f1) substantially keeps a certain value as shown by an actual line illustrated in FIG. 6B, when the reactance element (X1) is capacitive (X1<0). On the other hand, variation of an input impedance (Rin) at the second frequency (f2) becomes small as shown by an alternate long and short dash line illustrated in FIG. 6B. Accordingly, variation of an input impedance (Xin) becomes large as shown by an alternate long and short dash line illustrated in FIG. 6B.

Further, when the reactance element (X1) is inductive (X1>0), variation of an input impedance (Zin) at the first frequency (f1) substantially keeps a certain value as shown by a dotted line illustrated in FIG. 6B. On the other hand, variation of an input impedance (Zin) at the second frequency (f2) becomes large as shown by an alternate long and two short dash line illustrated in FIG. 6B.

In the position (C)[3*b*/4] near the ground portion 11*a*, variation of an input impedance (Rin) at the first frequency (f1) becomes gentle as shown by an actual line illustrated in FIG. 6C, when the reactance element (X1) is capacitive (X1<0). On the other hand, variation of an input impedance (Rin) at the second frequency (f2) becomes small as shown by an alternate long and short dash line illustrated in FIG. 6C. Accordingly, variation of an input impedance (Xin) becomes large as shown by an alternate long and short dash line illustrated in FIG. 6C.

Further, when the reactance element (X1) is inductive (X1>0), variation of an input impedance (Rin) at the first frequency (f1) substantially keeps a certain value as shown by an actual line illustrated in FIG. 6C. Accordingly, variation of an input impedance (Xin) becomes gentle as shown by a dotted line illustrated in FIG. 6C. On the other hand, variation of an input impedance (Zin) at the second frequency (f2) becomes large as shown by an alternate long and two short dash line illustrated in FIG. 6C.

In the interim, it is required not only that variation of an input impedance (Rin) is small but also that variation of an input impedance (Xin) is large in order that the resonant frequency may be adjustable. Accordingly, in order that the second resonant frequency (f2) may be adjustable, it is necessary that the reactance element (X1<0) is loaded between the central position (B)[b/2] of the parallel portion 11*d* and the position (C)[3*b*/4] near the ground portion 11*a*.

Figure 7:
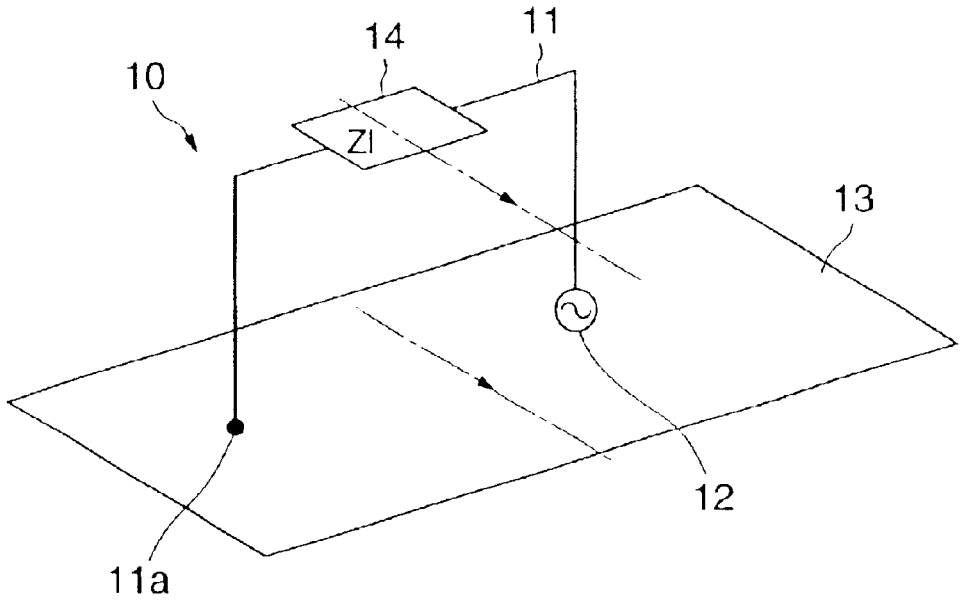
FIG. 7 is a first view for schematically showing a variation of a location of an impedance element of a lumped capacitance or inductance element in the antenna device illustrated in FIG. 1.
Figure 8:
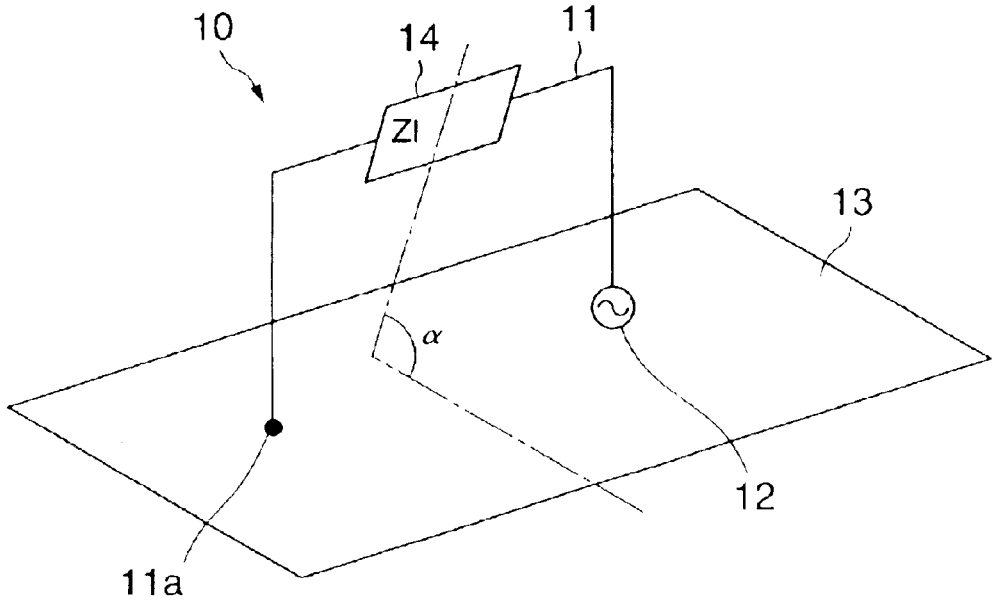
FIG. 8 is a second view for schematically showing a variation of a location of an impedance element of a lumped capacitance or inductance element in the antenna device illustrated in FIG. 1.

Besides, in a case that the impedance element 14 is a lumped capacitance or inductance element, the impedance element 14 is basically located on the antenna element 11 with the impedance element 14 being perpendicular to a principal surface of the conductive plate 13, as illustrated in FIG. 1. Alternatively, the impedance element 14 of a lumped capacitance or inductance element may be located on the antenna element 11 with the impedance element 14 being parallel to a principal surface of the conductive plate 13, as illustrated in FIG. 7. Further, the impedance element 14 of a lumped capacitance or inductance element may be located on the antenna element 11 with the impedance element 14 being inclined to a principal surface of the conductive plate 13 at a predetermined angle α, that is, between 0° and 90° (0[°]<α [°]<90[°]), as illustrated in FIG. 8.

Herein, description is made about operational effects, in a case that the impedance element 14 of a lumped capacitance or inductance element is located in parallel to the principal surface of the conductive plate 13, as illustrated in FIG. 7, in a case that the impedance element 14 is located in perpendicular to the principal surface of the conductive plate 13, as illustrated in FIG. 1, respectively. FIGS. 9A through 9D show a relation between the frequency (f[GHz]) and the return loss (RL[dB]), when a distance (S1), namely, a distance from the feed point 12 to a loading position of the impedance element 14 is varied.

As will be understood from FIGS. 9A through 9D, even though the impedance element 14 of a lumped capacitance or inductance element is located in parallel or perpendicular to the principal surface of the conductive plate 13, the second resonant frequency (f2) can be adjustable by loading the reactance element (X1) capacitive (X1<0) between the central position (B)[b/2] and the position (C)[3*b*/4] near the ground portion 11*a*.

Figure 10:
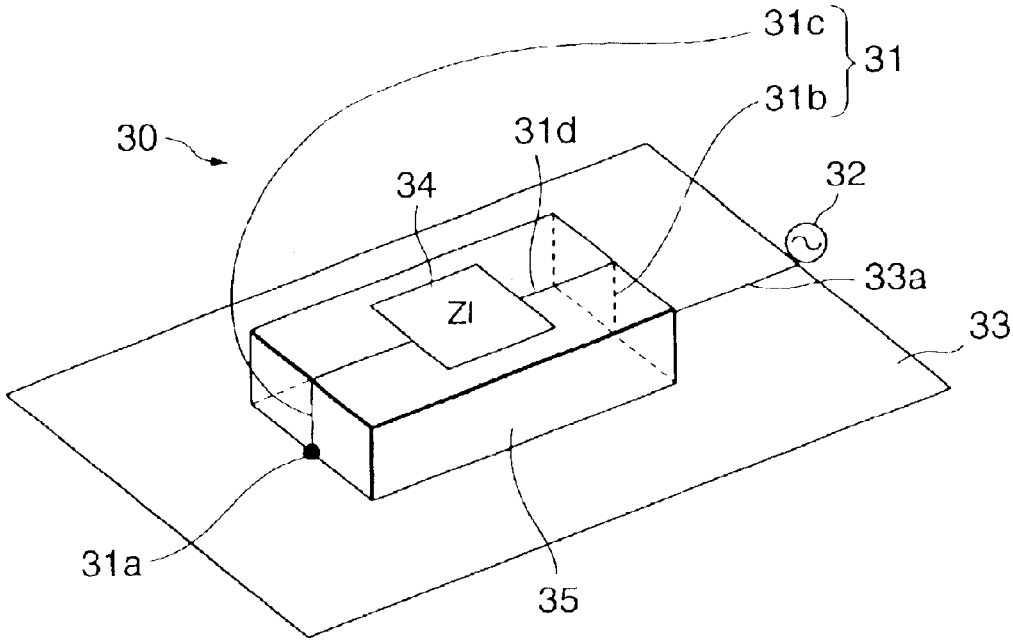
FIG. 10 is a perspective view for schematically showing an antenna device according to a third embodiment of the present invention.
Figure 11:
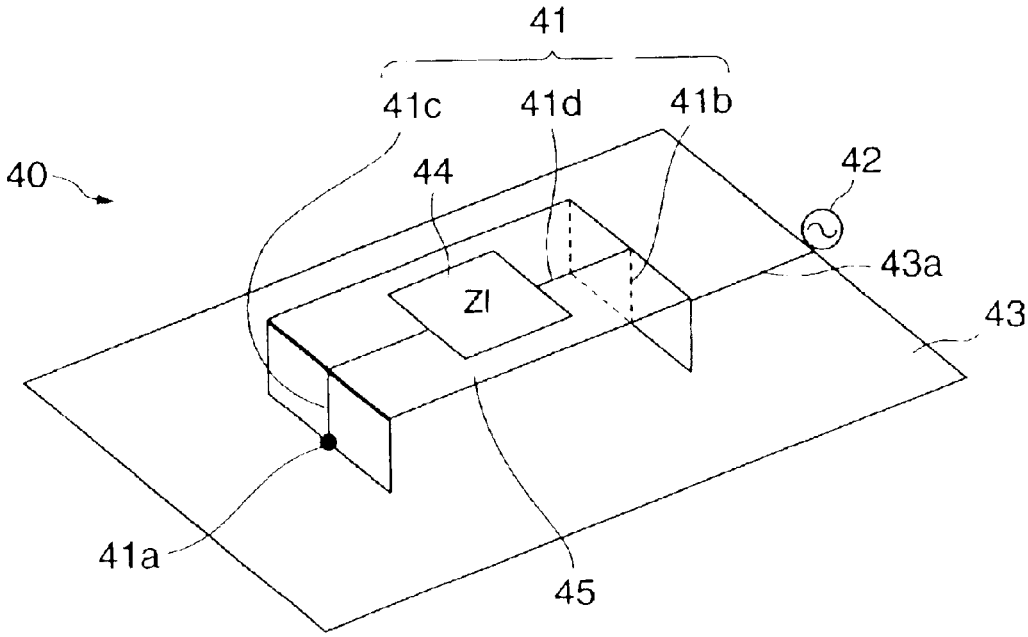
FIG. 11 is a perspective view for schematically showing an antenna device according to a fourth embodiment of the present invention.
Figure 12:
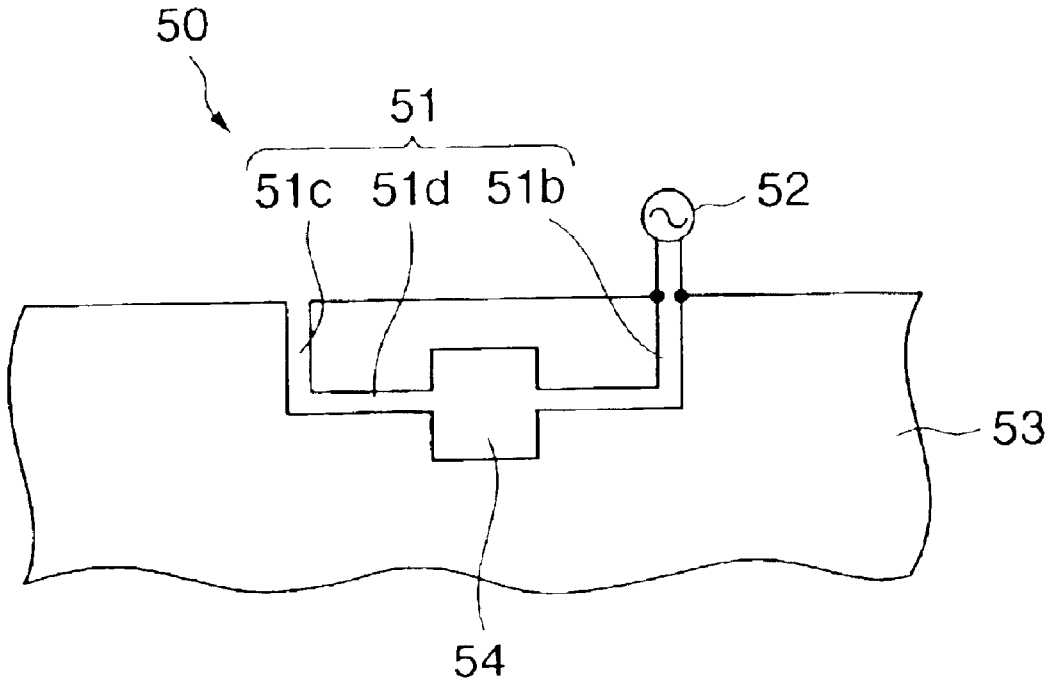
FIG. 12 is a view for schematically showing an antenna device according to a fifth embodiment of the present invention.

Next, referring to FIGS. 10 through 12, description will proceed to antenna devices according to third, fourth, and fifth embodiments of the present invention.

FIG. 10 is a perspective view for schematically showing an antenna device according to the third embodiment of the present invention.

As illustrated in FIG. 10, the antenna device 30 comprises an antenna element (first conductor) 31, a feed point 32, a conductive plate (second conductor) 33, an impedance element 34, and a dielectric block 35. The antenna element 31 is formed to have a shape of a semi-rectangular line, similarly to the antenna element 11 of the first embodiment. The antenna element 31 also includes a ground portion 31*a*, a feeding side perpendicular portion 31*b*, a grounding side perpendicular portion 31*c*, and a parallel portion 31*d*. The feed point 32 is located an end of the conductive plate 33. The impedance element 34 is similar to the impedance element 14 of the first embodiment, namely, a capacitance, an inductance, or the like used in an electronic circuit or a lumped capacitance or inductance element composed of an element having certain size and configuration. The dielectric block 35 is formed to have a hexahedron shape. In this embodiment, the antenna element 31 is formed on an upper surface and side surfaces opposite to each other of the dielectric block 35. Namely, the parallel portion 31*d* of the antenna element 31 is formed on an upper surface of the dielectric block 35 while the feeding side perpendicular portion 31*b* and the grounding side perpendicular portion 31*c* are formed on side surfaces of the dielectric block 35. The impedance element 34 is formed on the upper surface of the dielectric block 35 to be located halfway on the antenna element 31. With the structure, the dielectric block 35 is mounted on the conductive plate 33. Further, the feeding side perpendicular portion 31*b* is connected to the feed point 32 by way of a feed line formed on the conductive plate 33, for example a microstrip line 33*a*. On the other hand, the grounding side perpendicular portion 31*c* is grounded on the conductive plate 33 through the ground portion 31*a*.

FIG. 11 is a perspective view for schematically showing an antenna device according to the fourth embodiment of the present invention. The antenna device 40 according to the fourth embodiment illustrated in FIG. 11 has a structure basically similar to that of the antenna device 30 illustrated in FIG. 10 except that, in spite of the above-mentioned dielectric block 35, the antenna device 40 has a rectangular dielectric substrate 45 having both ends folded substantially perpendicular thereto and that an antenna element (first conductor) 41 and an impedance element 44 are formed on an upper surface and side surfaces opposite to each other of the rectangular dielectric substrate 45. With the structure, the rectangular dielectric substrate 45 is mounted on the conductive plate 43. Further, the feeding side perpendicular portion 41*b* is connected to the feed point 42 by way of a feed line formed on the conductive plate 43, for example a microstrip line 43*a*. On the other hand, the grounding side perpendicular portion 41*c* is grounded on the conductive plate 43 through the ground portion 41*a*.

FIG. 12 is a view for schematically showing an antenna device according to the fifth embodiment of the present invention. The antenna device 50 according to the fifth embodiment illustrated in FIG. 12 has, what is called, a complement pair structure. Namely, the antenna device 50 comprises a conductive plate 53, an antenna element 51 which is composed of a slit having a shape of a semi-rectangular line formed in the conductive plate 53, and the impedance element 54 which is composed of a cut portion formed in the conductive plate 53, as illustrated in FIG. 12. Besides, the antenna device 50 further comprises a feed point 52. The antenna element 51 of a slit includes three slit portions which function as a feeding side perpendicular portion 51*b*, a grounding side perpendicular portion 51*c*, and a parallel portion 51*d*, respectively. Further, the feed point 52 is connected to both edges of the slit portion functioning as the feeding side perpendicular portion 51*b*.

Referring to FIGS. 13 through 20, description will proceed to variations of a configuration of the impedance element 14 (24, 34, 44, and 54) of a lumped capacitance or inductance element.

As illustrated in FIG. 1, the impedance element 14 basically has a rectangular configuration having length(x)× width(y). Alternatively, variations of the configuration illustrated in FIGS. 13 through 20 can be applied to the impedance element 14 (24, 34, 44, and 54) of a lumped capacitance or inductance element.

Figure 13:
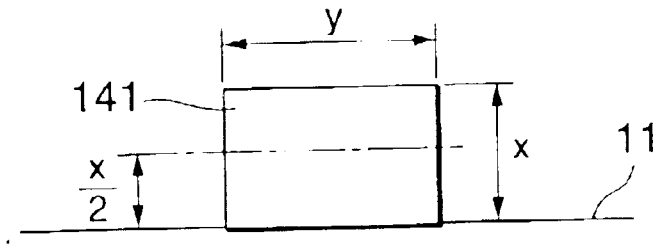
FIG. 13 is a first view for schematically showing a variation of a configuration of an impedance element of a lumped capacitance or inductance element in the antenna device illustrated in FIG. 1.

Namely, as illustrated in FIG. 13, an impedance element 141 has a rectangular configuration which has length(x)× width(y) and which is offset from the antenna element 11 by a predetermined length (x/2).

Figure 14:
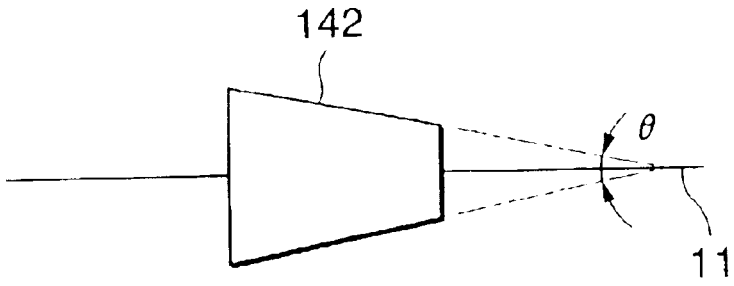
FIG. 14 is a second view for schematically showing a variation of a configuration of an impedance element of a lumped capacitance or inductance element in the antenna device illustrated in FIG. 1.
Figure 15:
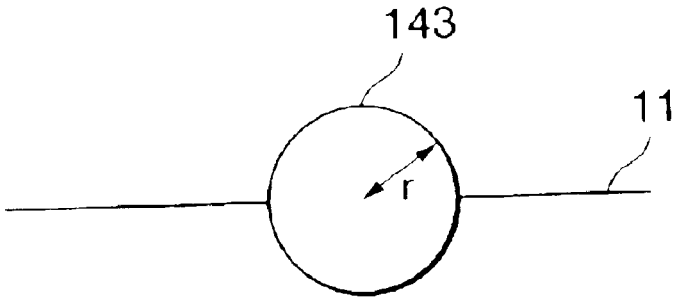
FIG. 15 is a third view for schematically showing a variation of a configuration of an impedance element of a lumped capacitance or inductance element in the antenna device illustrated in FIG. 1.
Figure 16:
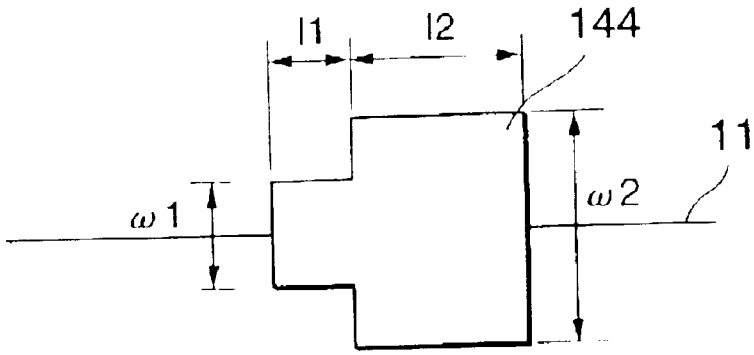
FIG. 16 is a fourth view for schematically showing a variation of a configuration of an impedance element of a lumped capacitance or inductance element in the antenna device illustrated in FIG. 1.
Figure 17:
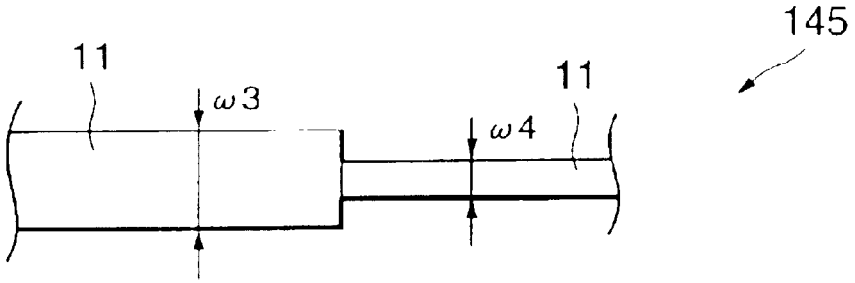
FIG. 17 is a fifth view for schematically showing a variation of a configuration of an impedance element of a lumped capacitance or inductance element in the antenna device illustrated in FIG. 1.

Next, an impedance element 142 illustrated in FIG. 14 has a trapezoidal configuration which has a taper of an angle (□). Further, an impedance element 143 illustrated in FIG. 15 has a circular configuration which has a radius of (r). Moreover, an impedance element 144 illustrated in FIG. 16 has a configuration which has a bump including width (w1) and width (w2) as well as length (l1) and length (l2). Furthermore, an impedance element 145 illustrated in FIG. 17 is composed of an antenna element 11 itself having a bump including width (w3) and width (w4).

Figure 18:
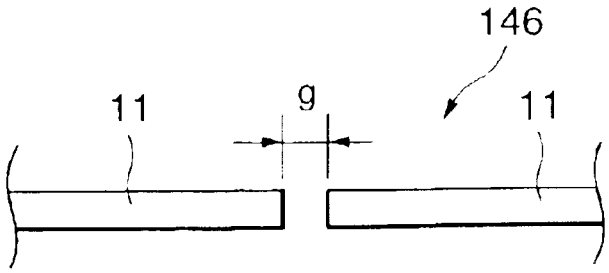
FIG. 18 is a sixth view for schematically showing a variation of a configuration of an impedance element of a lumped capacitance or inductance element in the antenna device illustrated in FIG. 1.

On the other hand, an impedance element 146 illustrated in FIG. 18 is composed of an antenna element 11 itself cut halfway thereon and having a gap (g) between both the cut portions thereof. Further, an impedance element 147 illustrated in FIG. 19A (a plan view) and FIG. 19B (a side view) is composed of an antenna element 11 itself cut halfway thereon and both the cut portions thereof are partially overlapped on each other. The impedance element 147 can therefore be realized, for example, by a substrate of a stacked-layer structure. Moreover, an impedance element 148 illustrated in FIG. 20 has a box-like three-dimensional configuration. The impedance element 148 can be realized, for example, by folding both ends of a rectangular substrate so that the both ends may be perpendicular to the rectangular substrate.

Referring to FIGS. 21 through 29, description will proceed to variations of a location of the antenna device 10 (20, 30, 40, and 50).

As illustrated in FIG. 1, in the basic location of the antenna device 10, the antenna element 11 stands on the principal surface of the conductive plate 13. Alternatively, variations of the location illustrated in FIGS. 21 through 29 can be applied to the antenna device 10 (20, 30, 40, and 50).

Figure 21:
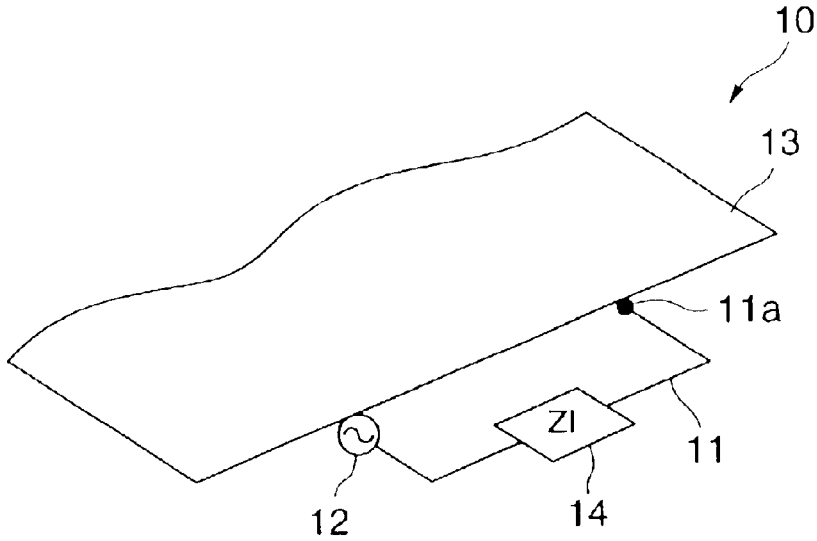
FIG. 21 is a first view for schematically showing a variation of a location of the antenna device illustrated in FIG. 1.

Namely, in the antenna device 10 illustrated in FIG. 21, the antenna element 11 is located on an end of the conductive plate 13 to be elongated horizontally to the principal surface of the conductive plate 13.

Figure 22:
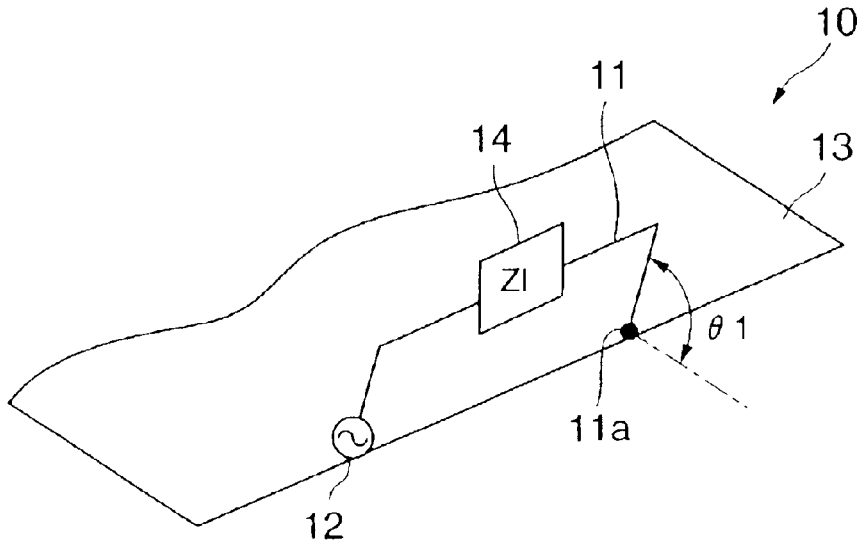
FIG. 22 is a second view for schematically showing a variation of a location of the antenna device illustrated in FIG. 1.
Figure 23:
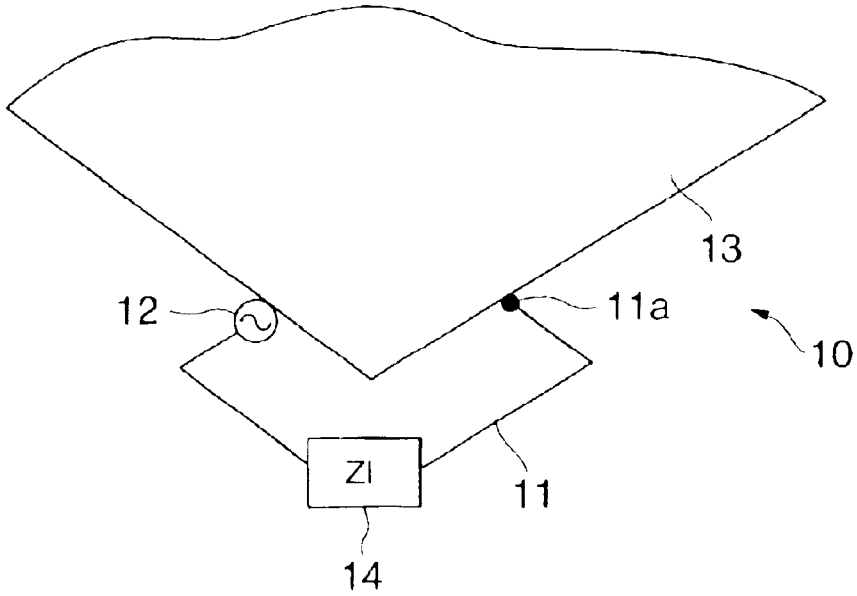
FIG. 23 is a third view for schematically showing a variation of a location of the antenna device illustrated in FIG. 1.
Figure 24:
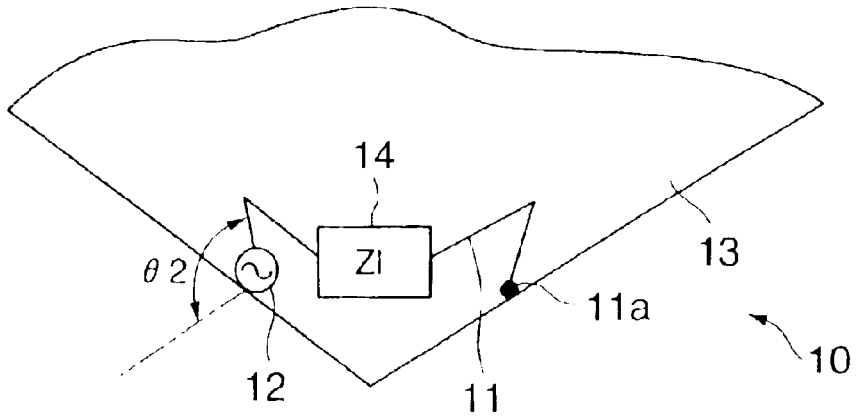
FIG. 24 is a fourth view for schematically showing a variation of a location of the antenna device illustrated in FIG. 1.
Figure 25A:
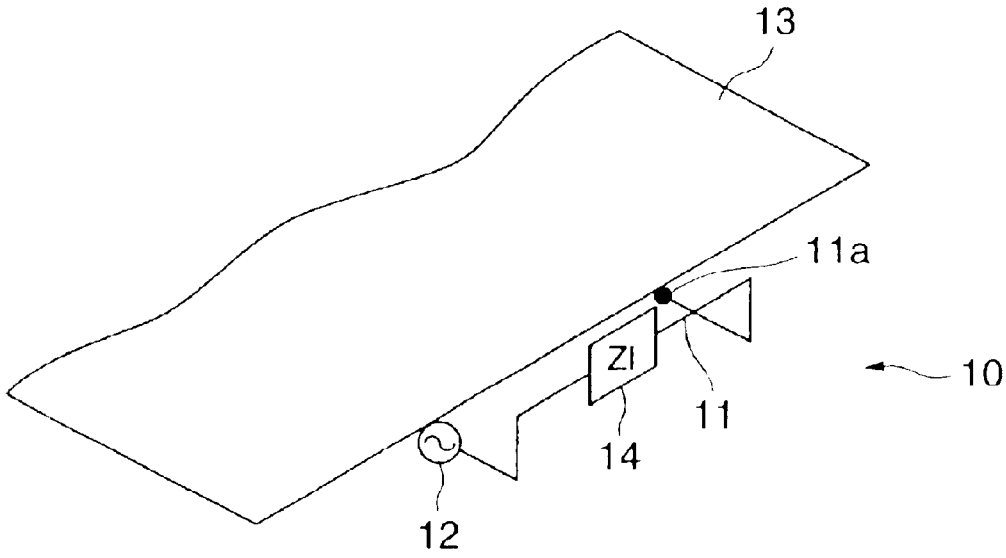
FIGS. 25A and 25B are fifth views for schematically showing a variation of a location of the antenna device illustrated in FIG. 1.
Figure 25B:
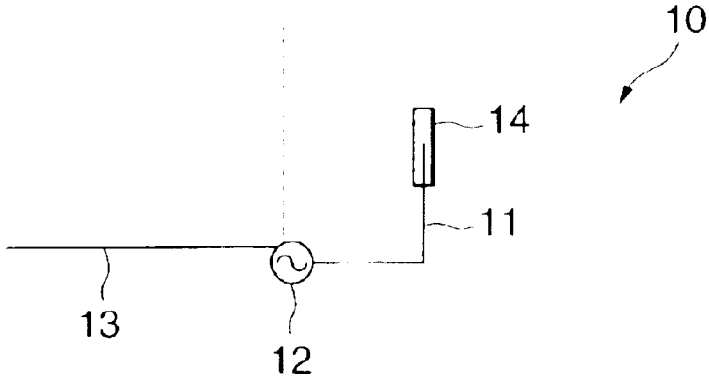

Next, in the antenna device 10 illustrated in FIG. 22, the antenna element 11 is located on the end of the conductive plate 13 to be inclined to the principal surface of the conductive plate 13 at a predetermined angle θ1, that is, between 0° and 180° (0[°]<θ1[°]<180[°]). Further, in the antenna device 10 illustrated in FIG. 23, the antenna element 11 is located on a corner of the conductive plate 13 to be elongated horizontally to the principal surface of the conductive plate 13 with the antenna element 11 being folded as depicted in FIG. 23. Moreover, in the antenna device 10 illustrated in FIG. 24, the antenna element 11 is located on the corner of the conductive plate 13 to be inclined to the principal surface of the conductive plate 13 at a predetermined angle θ2, that is, between 0° and 180° (0[°]<θ2[°]<180[°]). Furthermore, in the antenna device 10 illustrated in FIG. 25A (a perspective view) and FIG. 25B (a side view), the antenna element 11 is located on the conductive plate 13 to be once elongated therefrom horizontally and then folded perpendicularly to the principal surface of the conductive plate 13.

Figure 26:
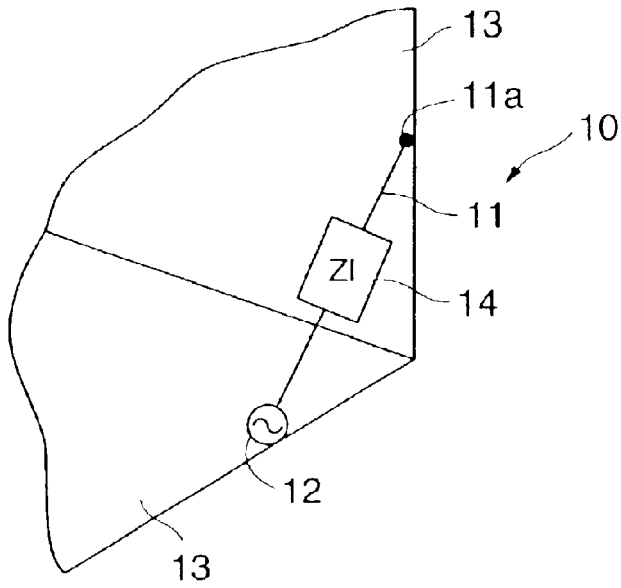
FIG. 26 is a sixth view for schematically showing a variation of a location of the antenna device illustrated in FIG. 1.
Figure 27:
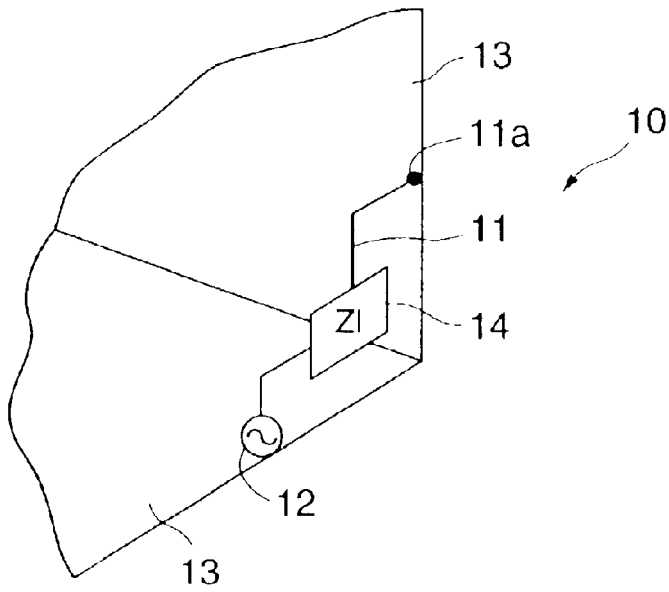
FIG. 27 is a seventh view for schematically showing a variation of a location of the antenna device illustrated in FIG. 1.
Figure 28:
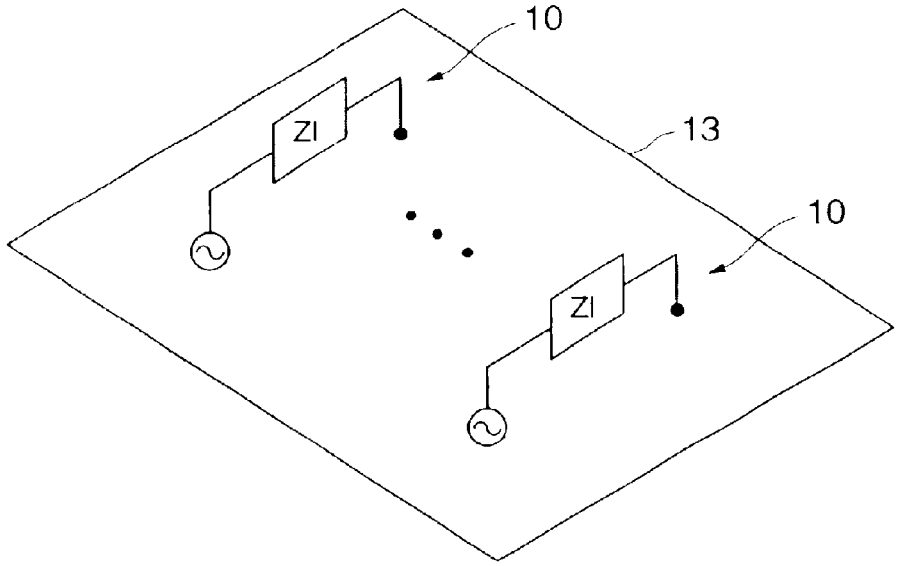
FIG. 28 is an eighth view for schematically showing a variation of a location of the antenna device illustrated in FIG. 1.
Figure 29:
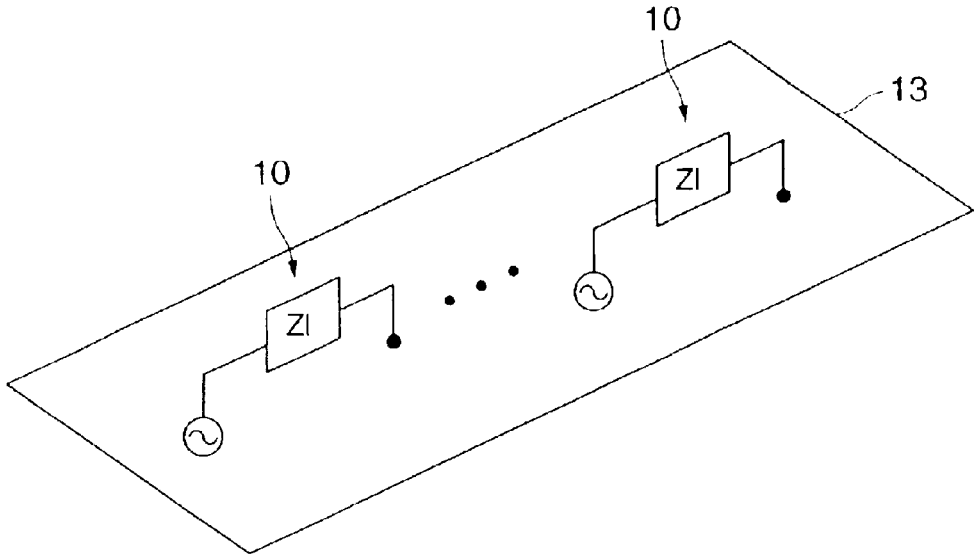
FIG. 29 is a ninth view for schematically showing a variation of a location of the antenna device illustrated in FIG. 1.

On the other hand, in the antenna device 10 illustrated in FIG. 26, the conductive plate 13 further comprises two conductive plates 13A and 13B which are perpendicular to each other. With the structure, the antenna element 11 is located obliquely between ends of the two conductive plates 13A and 13B, as illustrated in FIG. 26. Further, in the antenna device 10 illustrated in FIG. 27, the conductive plate 13 further comprises two conductive plates 13A and 13B which are perpendicular to each other, similarly to the antenna device 10 illustrated in FIG. 26. With the structure, the antenna element 11 is located between ends of the two conductive plates 13A and 13B with a center of the antenna element 11 being substantially folded vertically, as illustrated in FIG. 27. Moreover, a plurality of antenna devices 10 may be located in parallel on the principal surface of the conductive plate 13 at predetermined pitches, as illustrated in FIG. 28. Furthermore, a plurality of antenna devices 10 may be located in series on the principal surface of the conductive plate 13 at predetermined pitches, as illustrated in FIG. 29.

Referring to FIGS. 30 through 34, description will proceed to variations of a configuration of the antenna element 11 (21, 31, 41, and 51).

As illustrated in FIG. 1, in the basic configuration, the antenna element 11 is formed on a condition that an added value of length (h) of the feeding side perpendicular portion 11*b*, length (h) of the grounding side perpendicular portion 11*c*, and length (b) of the parallel portion 11*d* is electrically a half length (0.5 $\lambda_1$) of a wave-length of the first resonant frequency (f1). Alternatively, variations of the configuration illustrated in FIGS. 30 through 34 can be applied to the antenna element 11 (21, 31, 41, and 51).

Figure 30:
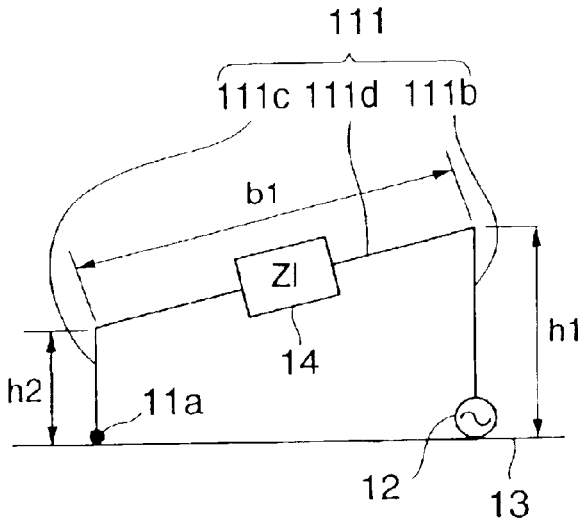
FIG. 30 is a first view for schematically showing a variation of a configuration of the antenna element of the antenna device illustrated in FIG. 1.
Figure 31:
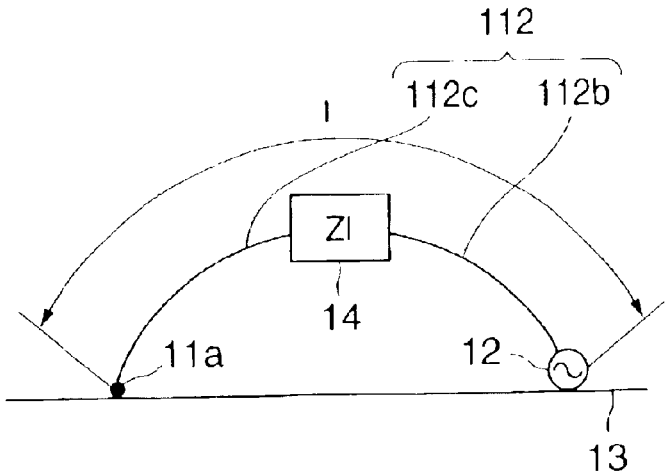
FIG. 31 is a second view for schematically showing a variation of a configuration of the antenna element of the antenna device illustrated in FIG. 1.

Namely, the antenna element 111 illustrated in FIG. 30 is formed to include an inclined portion. Namely, the antenna element 111 comprises the feeding side perpendicular portion 111*b* having a length (h1), the grounding side perpendicular portion 111*c* having a length (h2,[h2<h1]), and the inclined portion 111*d* having a length (b1). With the structure, the antenna element 111 illustrated in FIG. 30 is formed on a condition that an added value of length (h1) of the feeding side perpendicular portion 111*b*, length (h2) of the grounding side perpendicular portion 111*c*, and length (b1) of the inclined portion 111*d* is electrically a half length (0.5 $\lambda_1$) of a wave-length of the first resonant frequency (f1). Next, the antenna element 112 illustrated in FIG. 31 is formed to be arc-shaped. Namely, the antenna element 112 comprises the feeding side arc portion 112*b* and the grounding side arc portion 112*c*. With the structure, the antenna element 112 illustrated in FIG. 31 is formed on a condition that an added value (1) of a length of the feeding side arc portion 112*b* and a length of the grounding side arc portion 112*c* is electrically a half length (0.5 $\lambda_1$) of a wave-length of the first resonant frequency (f1).

Figure 32:
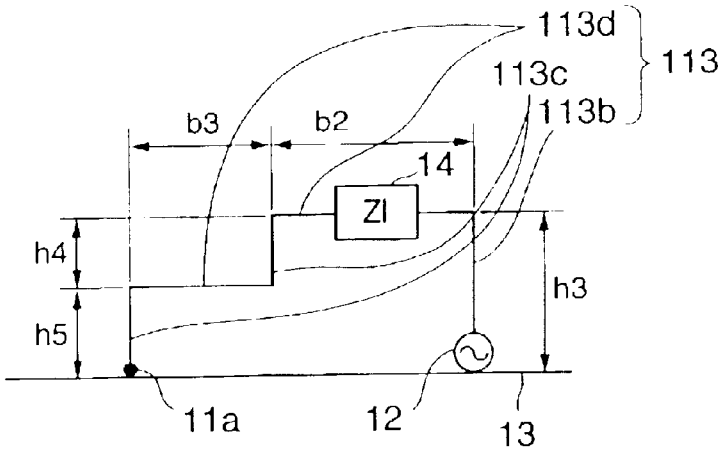
FIG. 32 is a third view for schematically showing a variation of a configuration of the antenna element of the antenna device illustrated in FIG. 1.

Further, the antenna element 113 is formed to have a bump, as illustrated in FIG. 32. Namely, the antenna element 113 includes the feeding side perpendicular portion 113*b* having a length (h3), the grounding side bump portion 113*c* which includes an upper stage having a length (h4) and a lower stage having a length (h5), the parallel portion 113*d* which includes an upper stage having a length (b2) and a lower stage having a length (b3). With the structure, the antenna element 113 illustrated in FIG. 32 is formed on a condition that an added value of length (h3) of the feeding side perpendicular portion 113*b*, length (h4) of the upper stage of the grounding side bump portion 113*c*, length (h5) of the lower stage of the grounding side bump portion 113*c*, length (b2) of the upper stage of the parallel portion 113*d*, and length (b3) of the lower stage of the parallel portion 113*d* is electrically a half length (0.5 $\lambda_1$) of a wave-length of the first resonant frequency (f1). In addition, the impedance element 14 is loaded on the upper stage of the parallel portion 113*d*.

Figure 33:
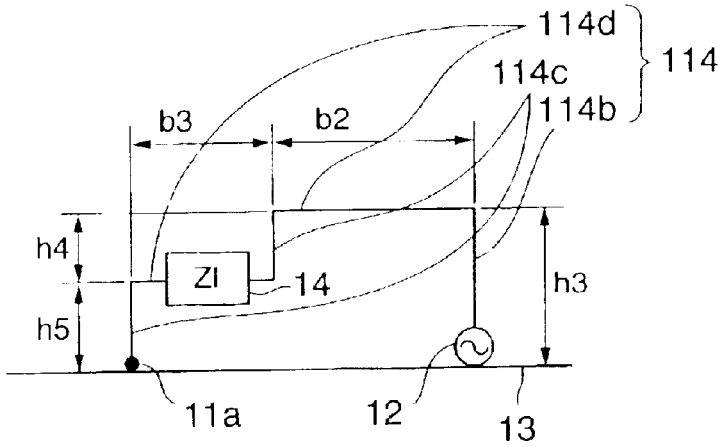
FIG. 33 is a fourth view for schematically showing a variation of a configuration of the antenna element of the antenna device illustrated in FIG. 1.
Figure 34:
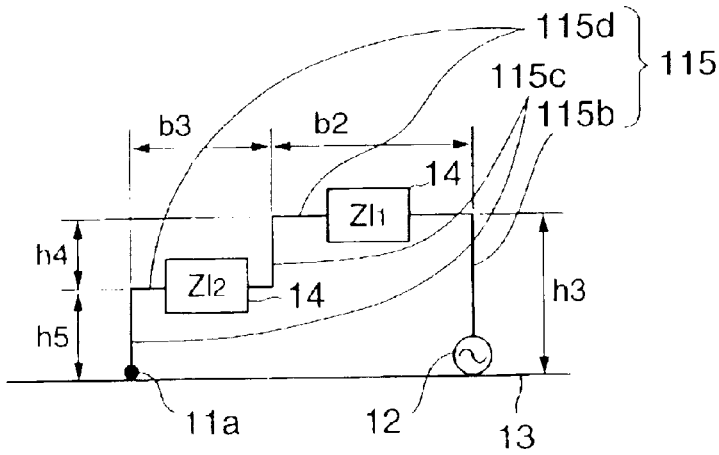
FIG. 34 is a fifth view for schematically showing a variation of a configuration of the antenna element of the antenna device illustrated in FIG. 1.

On the other hand, the antenna element 114 illustrated in FIG. 33 has a structure similar to that of the antenna element 113 illustrated in FIG. 32 except that the impedance element 14 is loaded on the lower stage of the parallel portion 114*d*. Further, the antenna element 115 illustrated in FIG. 34 has a structure similar to that of the antenna element 113 illustrated in FIG. 32 except that the impedance elements 14 are loaded on the upper and the lower stages of the parallel portion 115*d*, respectively.

Figure 35A:
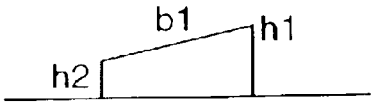
FIGS. 35A and 35B are views for showing a relation between the frequency and the return loss, when a length of a grounding side perpendicular portion of the antenna element illustrated in FIG. 30, and a length of an inclined portion of the antenna element illustrated in FIG. 30 are varied, respectively.
Figure 35B:
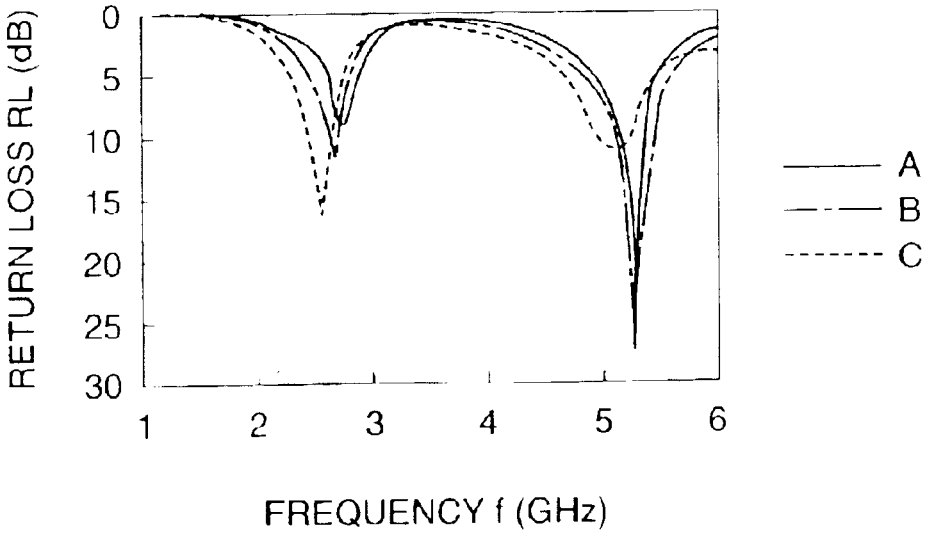

FIGS. 35A and 35B show a relation between the frequency (f[GHz]) and the return loss (RL[dB]), when the length (h2) of the grounding side perpendicular portion 111*c* of the antenna element 111 illustrated in FIG. 30, and the length (b1) of the inclined portion hid of the antenna element 111 illustrated in FIG. 30 are varied, respectively. As will be understood from FIGS. 35A and 35B, an input impedance can be adjusted by changing the length (h2) of the grounding side perpendicular portion 111*c* and the length (b1) of the inclined portion 11*d*.

Figure 36A:
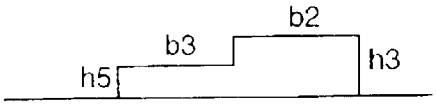
FIGS. 36A and 36B are views for showing a relation between the frequency and the return loss characteristics, when a length of an upper stage, a length of a lower stage of a parallel portion of the antenna element illustrated in FIG. 32 are varied, respectively.
Figure 36B:
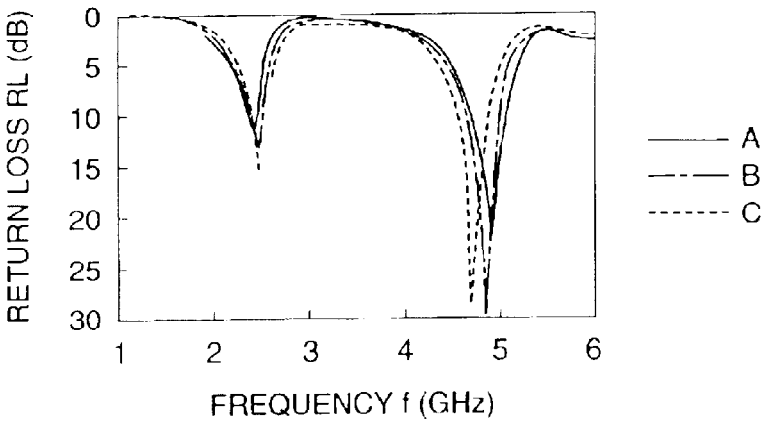

FIGS. 36A and 36B show a relation between the frequency (f[GHz]) and the return loss (RL[dB]), when the length (b2) of the upper stage, the length (b3) of the lower stage of the parallel portion 113*d* of the antenna element 113 illustrated in FIG. 32 are varied, respectively. As will be understood from FIGS. 36A and 36B, an input impedance can be adjusted by changing the length (b2) of the upper stage of the parallel portion 113*d* and the length (b3) of the lower stage thereof.

As described above, according to the present invention, the antenna element 11(first conductor) located on the conductive plate 13 (second conductor) can be picked up its electrical image at a symmetrical position with respect to the conductive plate 13 (second conductor). Further, it can be considered that a loop antenna 1 is composed of both the antenna element 11 (first conductor) and the electrical image thereof to have the perimeter of a wave-length (1λ) of the first resonant frequency (f1). The antenna element 11(first conductor) can be resonated at a desirable second resonant frequency (f2) by loading a predetermined impedance element halfway on the antenna element 11(first conductor). Accordingly, a compact antenna device 10 can therefore be constituted so that an impedance matching between the antenna element 11 (first conductor) and the feed point 12 may be readily obtained. In addition, the antenna device 10 can be commonly used with respect to a plurality of frequencies.

While this invention has thus far been described in conjunction with several embodiments thereof, it will now be readily possible for one skilled in the art to put this invention into effect in various other manners. For example, in the embodiments mentioned above, description was made about a case that the antenna device was incorporated in a computer. However, the present invention is not restricted to such a case. The present invention can be applied to an electronic equipment capable of communication, such as a portable telephone, PDA (Personal Digital Assistants), and the like.

What is claimed is:

1. An antenna device for use in an electronic equipment, comprising:

a first conductor having a length which is a half length of a wavelength for a first resonant frequency;

a feed point to which an end of the first conductor is connected;

a plate-shaped second conductor on which the feed point is located and on which another end of the first conductor is grounded; and an impedance element which is loaded on the first conductor and which varies at least one of the first resonant frequency and a second resonant frequency, wherein said first conductor comprises a primary portion extending from the plate-shaped second conductor, said impedance element being loaded on said first conductor in a position other than said primary portion, and wherein a length of said primary portion is in a range from 0.05 to 0.10 times a wavelength of the first resonant frequency.

2. An antenna device as claimed in claim 1, wherein the impedance element varies the first resonant frequency.

3. An antenna device as claimed in claim 1, wherein the impedance element varies the second resonant frequency.

4. An antenna device as claimed in claim 1, wherein the impedance element varies both the first resonant frequency and the second resonant frequency.

5. An antenna device as claimed in claim 1, wherein the first conductor comprises a semi-rectangular shaped conductor, said first conductor defining a first longitudinal section and two end sections of a rectangle, and said plate-shaped second conductor defining a second longitudinal section of said rectangle.

6. An antenna device as claimed in claim 5, wherein the first conductor comprises a line-shaped conductor.

7. An antenna device as claimed in claim 5, wherein the first conductor comprises a belt-shaped conductor.

8. An antenna device as claimed in claim 1, wherein the first conductor further comprises:

a secondary portion other than the primary portion.

9. An antenna device as claimed in claim 8, wherein said length of said primary portion is in a range of 0.07 and 0.08 times said wavelength of said first resonant frequency.

10. An antenna device as claimed in claim 8, wherein said impedance element is located on the secondary portion, and is offset from a center of the secondary portion towards a grounded side of the first conductor.

11. An antenna device as claimed in claim 1, wherein the impedance element comprises one of a lumped capacitance element and inductance element.

12. An antenna device as claimed in claim 11, wherein said one of the lumped capacitance element and inductance element comprises a rectangular element.

13. An antenna device as claimed in claim 1, wherein the first conductor is formed on a hexahedron-shaped dielectric block.

14. An antenna device as claimed in claim 1, wherein the first conductor is formed on a dielectric substrate.

15. An antenna device for use in an electronic equipment, comprising:

a first conductor having a length which is a half length of a wavelength for a first resonant frequency;

a feed point to which an end of the first conductor is connected;

a plate-shaped second conductor on which the feed point is located and on which another end of the first conductor is grounded; and an impedance element which is loaded on the first conductor and which varies at least one of the first resonant frequency and a second resonant frequency, wherein the plate-shaped second conductor comprises a slit; said first conductor being formed in said slit.

16. An electronic equipment including the antenna device as claimed in claim 1, wherein the electronic equipment transmits information to the outside thereof and receives information from the outside thereof by a radio communication using the antenna device.

17. An electronic equipment as claimed in claim 16, wherein said electronic equipment comprises a computer which is part of a local area network (LAN).

18. An antenna device for use in electronic equipment, comprising:

a conductive plate;

a feed point formed on said conductive plate;

an antenna element having a length which is equal to one-half of a wavelength for a first resonant frequency, said antenna element comprising:

a first end which is grounded on said conductive plate; and a second end which is connected to said feed point; and an impedance element which is loaded on the antenna element and which varies at least one of the first resonant frequency and a second resonant frequency, wherein said antenna element comprises a primary portion extending from the conductive plate, said impedance element being loaded on said antenna element in a position other than said primary portion, and wherein a length of said primary portion is in a range from 0.05 to 0.10 times a wavelength of the first resonant frequency.

19. An antenna device as claimed in claim 1, wherein said first conductor and an electrical image of said first conductor form a loop antenna, a perimeter of said loop antenna having a length which is equal to said wavelength of said first resonant frequency.

20. An antenna device as claimed in claim 1, wherein said impedance element comprises a reactance element.

21. An antenna device as claimed in claim 20, wherein a resonant frequency of said antenna device is increased by loading said reactance element capacitive, and is decreased by loading said reactance element inductive.

22. An antenna device as claimed in claim 8, wherein an input impedance is varied by varying a loading position of said impedance element along a length of said secondary portion.

23. An antenna device as claimed in claim 22, wherein said loading position of is one of approximately ¼ of a length of said secondary portion, approximately ½ of a length of said secondary portion, and ¾ of a length of said secondary portion, said length being measured from an end of said secondary portion nearest said feed point.

24. An antenna device as claimed in claim 22, wherein said loading position of is located between approximately ½ of a length of said secondary portion, and ¾ of a length of said secondary portion, said length being measured from an end of said secondary portion nearest said feed point.

25. An antenna device as claimed in claim 1, wherein said impedance element comprises one of a trapezoidal-shaped element, a circular-shaped element, and a T-shaped element.

26. An antenna device as claimed in claim 1, wherein said impedance element comprises a first portion, and a second portion which is separated from said first portion by a gap.

27. An antenna device as claimed in claim 1, wherein said impedance element comprises a first portion, and a second portion which is separated from said first portion.

28. An antenna device as claimed in claim 27, wherein said first portion and said second portion are collinear and have ends which are separated by a gap.

29. An antenna device as claimed in claim 28, wherein said first portion and said second portion have a stacked-layer structure.

30. An antenna device as claimed in claim 27, wherein said impedance element comprises a box-shaped, three-dimensional configuration.

31. An antenna device as claimed in claim 30, wherein said first portion and said second portion have a stacked-layer structure.

32. An antenna device as claimed in claim 1, wherein said first conductor is one of horizontally-formed on a principal surface of said plate-shaped second conductor, angularly-formed on a principal surface of said plate-shaped second conductor, horizontally-formed on an end of said plate-shaped second conductor, angularly-formed on an end of said plate-shaped second conductor, horizontally-formed on a corner of said plate-shaped second conductor, angularly-formed on a corner of said plate-shaped second conductor.

33. An antenna device as claimed in claim 1, wherein said first conductor is horizontally-formed on a principal surface of said plate-shaped second conductor, and comprises a bent portion which is perpendicular to said second conductor.

34. An antenna device for use in an electronic equipment, comprising:

a first conductor having a length which is a half length of a wavelength for a first resonant frequency;

a feed point to which an end of the first conductor is connected;

a plate-shaped second conductor on which the feed point is located and on which another end of the first conductor is grounded; and an impedance element which is loaded on the first conductor and which varies at least one of the first resonant frequency and a second resonant frequency, wherein said first conductor comprises a primary portion extending from the plate-shaped second conductor, said impedance element being loaded on said first conductor in a position other than said primary portion, and wherein said plate-shaped second conductor comprises first and second conductive plates having a perpendicular configuration, said end of said first conductor being connected to an end of said first conductive plate, and said another end of said first conductor being connected to an end of said second conductive plate.

35. An antenna device as claimed in claim 1, wherein said first conductor comprises a plurality of first conductors which are formed on a principal surface of said plate-shaped second conductor.

36. An antenna device for use in an electronic equipment, comprising:

a first conductor having a length which is a half length of a wavelength for a first resonant frequency;

a feed point to which an end of the first conductor is connected;

a plate-shaped second conductor on which the feed point is located and on which another end of the first conductor is grounded; and an impedance element which is loaded on the first conductor and which varies at least one of the first resonant frequency and a second resonant frequency, wherein said first conductor comprises a primary portion extending from the plate-shaped second conductor, said impedance element being loaded on said first conductor in a position other than said primary portion, wherein the first conductor further comprises:

a secondary portion other than the primary portion, the primary portion being formed to have a length in a range from 0.05 and 0.10 times a wavelength of a first resonant frequency, and wherein said secondary portion comprises a feeding side perpendicular portion, and a grounding side perpendicular portion having a length which is less than a length of said feeding side perpendicular portion.

37. An antenna device as claimed in claim 36, wherein said secondary portion comprises an upper stage connected to said feeding side perpendicular portion, and a lower stage connected to said grounding side perpendicular portion.

38. An antenna device as claimed in claim 37, wherein said impedance element is formed on one of said upper stage of said secondary portion, and said lower stage of said secondary portion.

39. An antenna device as claimed in claim 38, wherein said impedance element comprises a pair of impedance elements, one of said pair being formed on said upper stage of said secondary portion, and one of said pair being formed on said lower stage of said secondary portion.

* * * * *